United States Patent [19]

Beck

[11] Patent Number: 4,563,123

[45] **Date of Patent: * Jan. 7, 1986**

[54] DIRECT COUPLING OF A VORTEX INJECTOR TO A CENTRIFUGAL PUMP

[75] Inventor: Jeffrey L. Beck, Ponca City, OK

[73] Assignee: Conoco Inc., Ponca City, Okla.

[ * ] Notice: The portion of the term of this patent subsequent to May 22, 2001 has been disclaimed.

[21] Appl. No.: 531,517

[22] Filed: Sep. 12, 1983

[51] Int. Cl.[4] ..... F03B 11/08

[52] U.S. Cl. ..... 415/52; 415/1; 415/53 R; 406/93

[58] Field of Search ..... 415/168, 1, 52, 121, 415/53 R, 121 A; 209/211, 144; 37/58, 195; 406/93, 96, 109, 152, 153, 197; 417/54, 65, 171, 194; 366/137

[56] References Cited

U.S. PATENT DOCUMENTS

| | | | |
|---|---|---|---|
| 3,010,766 | 11/1961 | Coski | 406/109 X |
| 3,277,926 | 10/1966 | Skardal | 209/211 X |
| 3,708,239 | 1/1973 | Stahle | 417/171 X |
| 3,746,173 | 7/1973 | Daniel | 209/211 X |
| 4,114,955 | 9/1978 | Araoka | 406/98 |
| 4,227,863 | 10/1980 | Sommerer | 417/171 X |
| 4,234,274 | 11/1980 | Hoshall | 406/93 |
| 4,399,027 | 8/1983 | Miller | 209/211 X |
| 4,409,746 | 10/1983 | Beck | 37/58 |
| 4,444,229 | 4/1984 | Beck | 37/58 |
| 4,449,862 | 5/1984 | Beck | 406/93 |
| 4,451,184 | 5/1984 | Mitchell | 406/93 X |

*Primary Examiner*—Robert E. Garrett
*Assistant Examiner*—John Kwon
*Attorney, Agent, or Firm*—William J. Miller

[57] ABSTRACT

A method for reducing the wear on the impeller and increasing the efficiency of a centrifugal pump when used to pump a slurry stream containing from large dimensioned to fine dimensioned material in a fluid by forming a vortex by injecting fluid tangentially into a circular chamber and removing a portion of said fluid tangentially from said chamber; injecting said slurry axially into said chamber, said vortex separating said large dimensioned material from the remainder of said slurry and fluid; removing said remainder of said slurry and fluid axially from said chamber and injecting same into the inlet of a centrifugal pump; and using the output from said centrifugal pump as the injected fluid for said vortex.

5 Claims, 2 Drawing Figures

DIRECT COUPLING OF A VORTEX INJECTOR TO A CENTRIFUGAL PUMP

BRIEF DESCRIPTION OF THE PRIOR ART

The best prior art known to Applicant is U.S. application Ser. No. 218,857 filed Dec. 22, 1980, entitled "Vortex Injection Method and Apparatus" by the same inventor as this application and assigned to the same assignee. Such application discloses a single vortex injector having a high pressure inlet and outlet tangentially coupled to a cylinder vortex chamber using low pressure axial inlet and outlet.

U.S. Pat. No. 4,114,955 issued Sept. 19, 1978, entitled "Method and Apparatus for Transferring Material with The Use of a Fluid" by T. Araoka discloses an injection apparatus which differs from the apparatus described herein since it includes an impeller in the chamber of the vortex injection apparatus.

BRIEF DESCRIPTION OF THE INVENTION

This invention describes a method for reducing the wear on a centrifugal pump impeller and increasing the overall efficiency of the centrifugal pump when used to pump a slurry stream containing large dimensioned material, fine dimensioned material and intermediate dimensioned material in a fluid. The invention is accomplished by a vortex apparatus where the slurry is injected into a cylindrical chamber along the axis of the cylindrical chamber. Fluid is injected tangentially into the chamber and the vortex formed inside the chamber propels the large and intermediate dimensioned material to the outside periphery of the chamber and a tangential outlet removes the large and intermediate material. The small dimensioned material is exited axially and inputted into the inlet of the centrifugal pump. The output from the centrifugal pump is the tangential inlet fluid for the vortex. The invention provides a separation process for removing substantially all of the large dimensioned material from the fluid in the centrifugal pump thus the centrifugal pump need only pump fine dimensioned material, permitting the impeller to be dimensioned closer to the casing of the pump and substantially reducing the wear on the centrifugal pump. Furthermore, since fine dimensioned material is the only material being pumped, the pump can be operated at a higher rpm.

The axial outlet of the vortex injector can be coupled directly to the input of the centrifugal pump or it can be coupled through a pipe to the centrifugal pump.

DETAILED DESCRIPTION OF THE FIGURES

Similar numbers will be used throughout the specification for similar parts.

Figure 1:
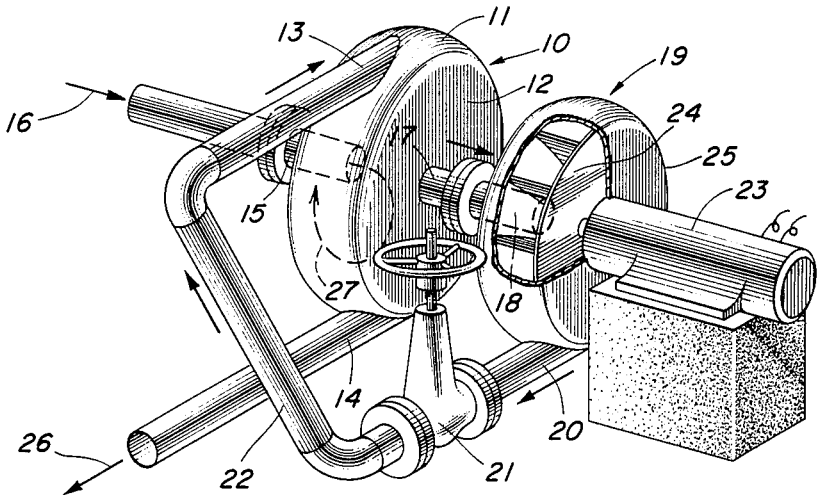
FIG. 1 illustrates the preferred embodiment of the invention with the vortex injector coupled directly to the centrifugal pump input and FIG. 2 illustrates a modified version of the apparatus illustrated in FIG. 1.
Figure 2:
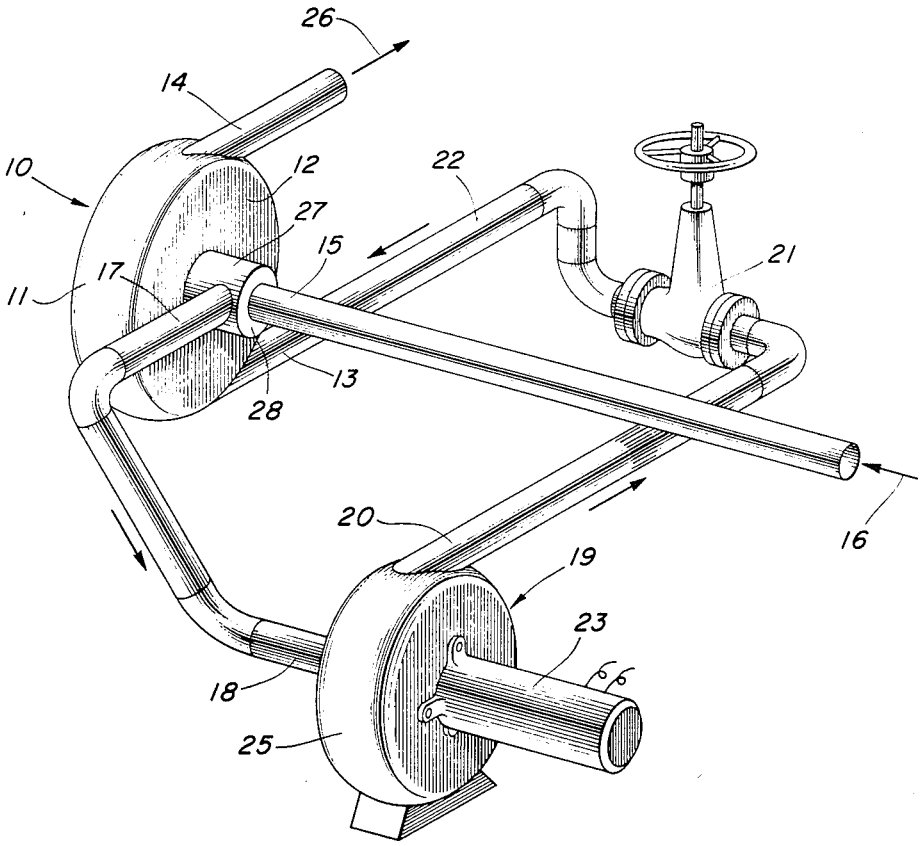

Referring to both FIGS. 1 and 2 but in particular to FIG. 1, a vortex injector, generally referred by the arrow 10, has a centrifugal casing comprising side walls 11 and end wall 12 with an opposite end wall, not illustrated. A tangential inlet 13 is attached through side wall 11. A tangential outlet 14 is attached, likewise, through side wall 11. An axial inlet 15 is attached through the side wall opposite side wall 12 so that material moving in the direction of arrow 16 can pass to the interior of vortex injector 10. An axial outlet 17 is attached through side wall 12 and is coupled directly to the inlet 18 of a centrifugal pump, generally referred to by arrow 19. The centrifugal pump outlet 20 is coupled through a valve 21 to a pipe 22 which is connected to inlet 13. A motor, which may be an electric motor 23, is connected in the usual manner to impeller 24 inside the centrifugal pump casing 25.

Operation

The device of FIG. 1 operates in the following manner. Slurry containing large material, intermediate material and fines is injected in the direction of arrow 16 into the axial inlet 15 of vortex injector 10. High pressure fluid from centrifugal pump 19 is injected into the tangential inlet 13 forming a vortex on the inside of vortex injector 10 with fluid under high pressure exiting tangential outlet 14 in the direction of arrow 26. As the slurry is injected into axial inlet 15, it moves in the direction of arrow 27, if it is of sufficient weight. That material not having sufficient weight to move to the periphery of vortex injector 10 will pass directly to the axial outlet 17. Such material will generally comprise fines or small dimensioned intermediate particles. Thus the heavy material passing in the direction of arrow 27 will be caught up in the vortex inside vortex injector 10 passing out of the vortex chamber through tangential outlet 14 in the direction of arrow 26, while the small dimensioned or fine material will pass directly out of the tangential outlet 17 into the centrifugal pump inlet 18 where it will be pumped in the usual manner.

One of the main reasons for wear of centrifugal pumps used for slurry applications is the abrasive wear of large particles on not only the impeller 24 but also the casing 25 and the space between the impeller 24 and the casing. When fine material only is being pumped, less wear will be exhibited by the impeller 24 and casing 25, thus permitting the impeller to be closer to the casing. Such dimension will substantially increase the efficiency of the centrifugal pump. Furthermore, the removal of the large particles being pumped will substantially increase the life of the centrifugal pump impeller 24 and casing 25.

Control over the system can be exhibited through operation of valve 21 which permits regulation of the pressure at tangential inlet 13. The system can also be controlled by varying the rotational speed of impeller 24.

Referring to FIG. 2 the main variation in the embodiment between that shown in FIG. 1 is the position of the axial inlet 15 and the axial outlet 17. In this example, axial inlet 16 passes through side wall 12 with a tubular portion 27 functioning as the low pressure axial outlet. An end portion 28 is welded to tubular portion 27 and inlet 16 so that material, that is fines and fluid, can flow from the interior of vortex injector 10 up the tubular portion 27 and out outlet 17. The operation of FIG. 2, except for the particular location of the axial outlet, is substantially identical to that described in FIG. 1.

FIG. 1 illustrates a system wherein the direction of rotation is the same for both the vortex in vortex injector 10 and impeller 24. The positions of tangential inlet 13 and tangential outlet 14 through side wall 11 can be transposed such that the direction of rotation of the vortex in vortex injector 10 is opposite that of impeller 24.

It is obvious that other changes can be made in the application and still be within the spirit and scope of the invention as disclosed in the specification and appended claims.

What is claimed is:

1. A method for reducing the wear on the impeller and increasing the efficiency of a centrifugal pump when used to pump a slurry stream containing from large dimensioned to fine dimensioned material in a fluid comprising:

a. forming a vortex by injecting fluid tangentially into a circular chamber and removing a portion of said fluid tangentially from said chamber;

b. injecting said slurry axially into said chamber, said vortex separating said large dimensioned material from the remainder of said slurry and fluid;

c. removing said remainder of said slurry and fluid axially from said chamber and injecting same into the inlet of a centrifugal pump;

d. using the output from said centrifugal pump as the injected fluid for said vortex;

whereby said large dimensioned material is moved to the periphery of said vortex and removed resulting in small to intermediate dimensioned material and fluid being injected into said centrifugal pump thereby reducing the wear on said impeller and allowing said pump to be operated at a higher rotational speed and consequent improvement in efficiency.

2. The method as set out in claim 1 including controlling the flow of fluid injected from the centrifugal pump into said vortex chamber.

3. A method as set out in claim 1 wherein said slurry is injected into said chamber on the opposite side from where said remaining material and fluid is removed.

4. A method as set out in claim 1 wherein said slurry is injected into said chamber in the same side from where said remaining material and fluid is removed.

5. An apparatus for improving the efficiency and wear characteristics of a centrifugal pump when used to pump a slurry containing a substantial percentage of large material in a fluid comprising:

a. a chamber having substantially cylindrical side walls and end walls;

b. a tangential inlet and outlet;

c. a slurry inlet aligned axially with the said side walls and through one of said end walls;

d. a low pressure outlet aligned with the axis of said side wall and through one of said end walls;

e. a centrifugal pump having an inlet and an outlet, with said inlet coupled to the low pressure outlet of said chamber; and f. means coupling the outlet of said pump to the tangential inlet of said chamber;

whereby fluid entering said tangential inlet will form a vortex inside said chamber so that when slurry is injected into said axial inlet said substantial percentage of large material will be propelled to the outside of said chamber by said vortex and said remaining material will enter said centrifugal pump, said pump being able to operate at a higher rotational speed with less wear since the large material is no longer introduced into said pump inlet.

* * * * *